United States Patent [19]

Drobniak

[11] 4,158,839

[45] Jun. 19, 1979

[54] TRANSITION ALARM CIRCUIT

[75] Inventor: Joseph M. Drobniak, Houston, Tex.

[73] Assignee: Powell Magnetic Industries, Inc., Houston, Tex.

[21] Appl. No.: 720,495

[22] Filed: Sep. 3, 1976

[51] Int. Cl.[2] ..... G08B 25/00

[52] U.S. Cl. ..... 340/524; 340/500; 328/99; 328/127

[58] Field of Search ..... 340/213.1, 213 R, 500, 340/524, 501, 503, 506; 328/99, 109, 127, 132, 140; 307/247, 294, 231

[56] References Cited

U.S. PATENT DOCUMENTS

| | | | |
|---|---|---|---|
| 3,112,475 | 11/1963 | Alessio | 340/213.1 |
| 3,138,759 | 6/1964 | Thompson | 328/140 |
| 3,149,243 | 9/1964 | Garfield | 328/140 |
| 3,264,626 | 8/1966 | Mounce | 340/213.1 |
| 3,305,732 | 2/1967 | Grossman et al. | 328/140 |
| 3,581,300 | 5/1971 | Eloranta | 340/213.1 |
| 3,636,432 | 12/1971 | Stallebrass | 340/213.1 |
| 3,688,294 | 8/1972 | Erpeldins, Jr. | 340/213.1 |
| 3,696,356 | 10/1972 | Franke et al. | 340/213.1 |

*Primary Examiner*—John W. Caldwell, Sr.

*Assistant Examiner*—Donnie L. Crosland

[57] ABSTRACT

A driver circuit designed to respond to one or more of a set of signals by conducting during transitory or other time variations of the signals but by otherwise remaining non conducting. The circuit includes an output driver and provisions for introducing a set of input signals. The output driver is actuated by a first resistance/capacitance network, the first network being responsive to any time variation of one or more of the input signals. The actuation by the first network of the output driver is inhibited by a second resistance/capacitance network after a period of time during which all of the input signals remain time invariant. The circuit further includes a light producing, audible or other alarm device driven by the output driver. The alarm device indicates the presence of a transitory or other time varying input signal. The circuit may also include a capacitor or other filter separating the first network from the second network. This filter prevents the reaction of the first network to time variations of more than one input signal occurring within fixed intervals of one another, the fixed intervals being determined by the filter time constant.

21 Claims, 2 Drawing Figures

TRANSITION ALARM CIRCUIT

BACKGROUND OF THE INVENTION

1. Field of the Invention

The present invention relates to transitory alarm systems.

2. Description of the Prior Art

The control of industrial plants includes the alarm surveillance of the states of the process variables associated with the plant, such as magnitude and change in magnitude of the pressures and temperatures. It is known in the art to perform such surveillance by use of electronic alarm systems monitoring the states of such variables. Such electronic alarm systems are usually contained in several large panels, each panel including numerous alarm indicators. Typically, there is an alarm indicator for each state monitored. The alarm indicator is usually a combination of a translucent nameplate and a lamp located behind the nameplate. The blinking of an alarm indicator lamp by an annunciator circuit accompanied by an audible signal is normally used to indicate the presence of a previously undetected abnormally deviant value of the state to a human operator. The operator, after identifying the variable from the blinking light, normally acknowledges the signal by actuating a portion of the annunciator circuit that silences the audible signal and inhibits further blinking of the lamp. The operator thereafter takes whatever action, if any, is necessary to remedy any problem in the industrial plant that may be causing the abnormally deviant value. The lamp is usually maintained in a steady burning condition by the circuit until the state has again reached a value within the permissible boundaries for the variable, at which time the lamp is turned off by the circuit. The effective use of such an alarm system mandates the ability to quickly detect any faulty lamps and replace them. The usual practice in the prior art is to provide each panel with a special test button that turns on all lamps. A faulty lamp may then be detected by ones that are not on.

However, none of the prior art alarm systems teach the use of additional electronic circuitry to enable the operator to determine which panels include indications of unacknowledged alarms. This would be especially useful when an audible signal is sounded indicating an alarm has occurred, and no light associated with a variable is blinking on any of the panels. Such a condition in the prior art systems requires all panels to be tested until the faulty lamp or lamps are located. It would also be useful when one light is blinking on one panel, but another light which should be blinking on another panel is burned out.

The control of industrial plants also includes the manipulation of valves and motors. The current state of such valves and motors is usually indicated on a graphic or semigraphic display by the use of lamps mounted behind a graphical depiction of the controlled plant. None of the prior art, however, utilizes a momentary flash of a light or audible signal or other indicator responsive to a change in any state of the valves and motors to call the attention of the operator to such a change.

SUMMARY OF THE INVENTION

The present invention utilizes unique circuitry to indicate time variations of one or more of a set of input signals and to remain quiescent when all of such input signals are time invarient for a fixed period of time. The circuit indicator for such an indication is an audible signal, a light or other suitable indicator device electrically connected with a power supply. The conduction of current by the power supply is regulated by a driver portion of the circuit. The driver portion is actuated by a first filter. The first filter actuates the driver portion in response to voltage resulting from the time variation of one or more signals. Voltage to the first filter is regulated by a set of second filters, each of which is connected to one input signal. Each of the second filters isolates its input signal from the first filter after the input signal has remained time invarient for a period of time fixed by the time constant of the second filters. A third filter may also be utilized between the first and second filters to prevent more than one of the input signals from actuating the first filter within a period of time set by the time constant of the third filter.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

DETAILED DESCRIPTION OF THE PREFERRED EMBODIMENT

Figure 1:
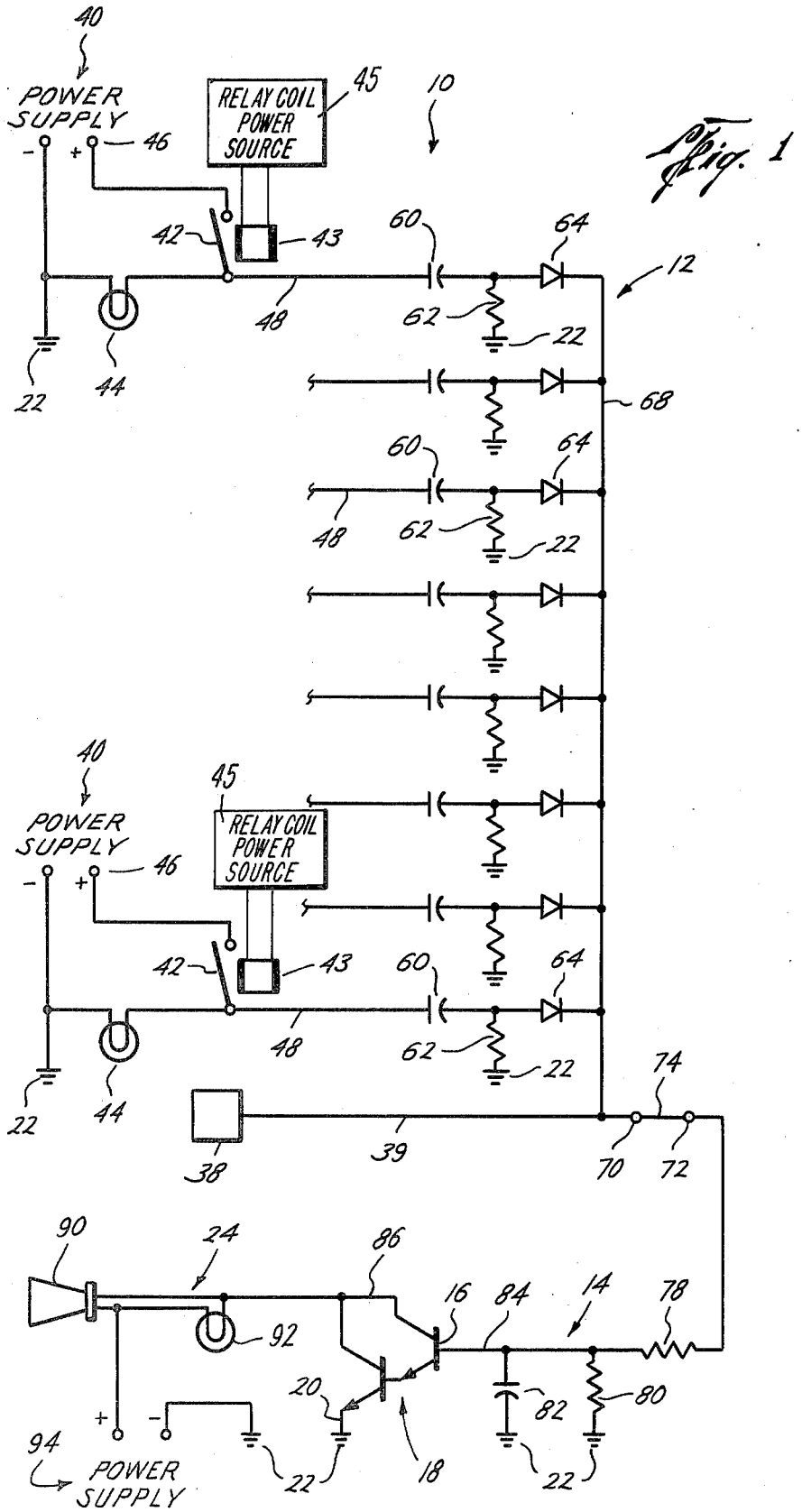
FIG. 1 is a schematic of the circuit of the preferred embodiment of the apparatus of the present invention without the filter that prevents circuit actuation within a given period of time of a previous actuation.

Referring to FIG. 1, there is shown a set of input circuits 10. Each of the input circuits 10 is electrically connected to an inhibiting filter 12. The inhibiting means including inhibiting or second filters 12 are each electrically connected in series to actuator filter 14. Filter 14 is connected in series to the regulation portion 16 of driver 18. The conducting path of driver 18 is connected on one side 20 to ground 22, which is the circuit common, and on the other side to an annunciator system 24.

Input circuits 10 in the preferred embodiment are typically portions of a state alarm system for process variables in an industrial plant. One input circuit 10 is an alarm indicator for each state of a variable monitored for alarm, as is well known in the art. Input circuits 10 may also be indicators of the actual state of process variables in an industrial plant, as is well known in the art. Each input circuit 10 includes a power source 40, a contact 42, and a lamp 44. Power source 40, for example, supplies voltage within a range of 6–28 volts, D.C., all power sources 40 having substantially the same voltage and may be a single power source connected in parallel to all input circuits 10. Power source 40 is electrically connected to ground 22 and contact 42, its electron attracting side 46 being connected in series to one side of contact 42. Contact 42 is, as is well known in the art, typically a relay contact, the coil 43 of which is electrically or electronically actuated by relay power source 45 to cause the contact to change to another state and stay in such state for a period of time. The other side of contact 42 is electrically connected in series to lamp 44. Lamp 44 is electrically connected in series to ground 22. The electrical connection between lamp 44 and contact 42 is also electrically connected by wire or land 48 to one of the set of inhibiting filters 12. Thus, wires or lands 48 constitute inputs to the circuit comprising inhibiting filters 12, actuator filter 14, driver 18 and annunicator system 24 and the signals appearing at such inputs constitute the input signals to such circuit.

Unit 38 represents an additional set or sets of input circuits 10 in combination with inhibiting filters 12. Unit 38 is electrically connected by electrical conductor 39 to actuator filter 14, optionally using terminals 70, 72 and jumper 74 interposed between them.

In the preferred embodiment, each filter 12 is a first order filter. Each filter 12 includes a capacitor 60, a resistor 62 and a diode 64. Capacitor 60 is electrically connected in series between corresponding wire 48 and the common junction of one side of resistor 62 and diode 64. The other side of resistor 62 is electrically connected to ground 22. The other side of diode 66 is electrically connected to common wire or land 68. The diode is oriented to permit the flow of current from resistor 62 to wire or land 68.

Wire or land 68 electrically connects to actuator filter 14, optionally using terminals 70, 72 and jumper 74 interposed between them.

In the preferred embodiment, actuator means including first or actuator filter 14 is a first order filter. Actuator filter 14 includes resistors 78, 80 and capacitor 82. One side of resistor 78 is electrically connected to wires or lands 39, 68 or optionally to terminal 72. The other side of resistor 78 is electrically connected to the common electrical connection of one side of a resistor 80 and capacitor 82. The other sides of resistor 80 and capacitor 82 are electrically connected to ground 22. The common electrical connection of resistors 78, 80 and capacitor 82 is also electrically connected to the regulation portion 16 of driver 18 by wire or land 84.

Driver 18 is a power transistor having suitable characteristics to pass the load of annunciator system 24. It includes regulation portion or base 16, emitter side 20 and collector side 86. Collector side 86 is electrically connected to annunciator system 24, and emitter side 20 is electrically connected to ground.

Annunciator system 24, in the preferred embodiment, comprises an electrically actuated audible signal generator or horn 90 and a light 92 connected to a power source 94. Horn 90 and light 92 are electrically connected in parallel, with one side of both electrically connected to collector 86, and the other side electrically connected to the electron receiving side of power source 94. The other side of power source 94 is connected to ground 22.

The contacts 42 respond to the variations of input circuits 10 according to the use of input circuits 10. If input circuits 10 are alarm indicators, contacts 42 will have three modes of operation:

(a) lamp 44 on and contact 42 closed for the state of a variable being in an alarm condition;
(b) lamp 44 off and contact 42 open for the state of a variable not being in an alarm condition; and
(c) lamp 44 alternately on and off and contact 42 alternately open and closed at a fixed rate per minute when the state is first detected in an alarm condition.

If input circuits 10 are indicators of states of variables, they will have two modes of operation:

(a) lamp 44 on and contact 42 closed for the variable being in the indicated state; and
(b) lamp 44 off and contact 42 open for the variable not being in the indicated state.

The values of the capacitors 60 and resistors 62, 78 and 80 should be selected to give filters 12 a predominant time constant less than the period of time contact 42 is permitted to stay in a changed state, typically from 0.05 seconds to 1 second. Also, the rating of the capacitors 60 may be any value sufficient to sustain the maximum voltage of power source 40. Diodes 64 may have any characteristics sufficient to pass the current required by the actuator filter 14.

The values of the capacitor 82 and resistors 62, 78 and 80 should be selected to give actuator filter 14 a predominant time constant less than the predominant time constant of inhibiting filters 12, typically five to thirty percent of the predominant time constant of filter 12. The predominant time constant of actuator filter 14 should also be selected to prevent noise signals, such as the bounce of contacts 42, from causing actuation of driver 18. Additionally, resistor 80 should be sufficiently low in value to quickly discharge capacitor 82 when current through resistor 78 falls to zero as described infra. Resistors 62, 78 and 80 must also be sized to permit sufficient voltage drop across resistor 80 to permit regulation portion 16 to be forward biased to force driver 18 to full conduction. The rating of capacitor 82 may be of any value sufficient to sustain the maximum voltage of power source 40.

Power source 94 typically has a voltage rating higher than the voltage of power source 40, such as 40 volts, D.C. Horn 90 and light 92 should be sized to sustain a drop across them equal to the voltage of power source 94 less the voltage drop from the collector 86 to the emitter 20 of driver 18 while maintaining the current below the maximum current permissible through output driver 18. Driver 18 in the preferred embodiment should have characteristics sufficient to support the maximum voltage drop of power source 94 when non conducting and a voltage of, for example, 1.0 to 1.5 volts at 0.5 to 1 amp of current when conducting.

In the preferred embodiment, capacitors 60 are 10 microfarad, 35 volt capacitors; resistors 62 are 47,000 ohm resistors; and diode 64 is a IN4007. Also capacitor 82 is a 47 microfarad, 35 volt capacitor; resistor 78 is a 10,000 ohm resistor; and resistor 80 is a 27,000 ohm resistor. Driver 18 is a MPS-U45 Darlington configured transistor pair.

The description infra of the operation of the circuit of the present invention presumes that all contacts 42 at the start of the description have been open for a time sufficient to discharge capacitors 60.

In operation, when one or more contacts 42 closes, the supply voltage of power source 40 appears between wire or land 48 and ground 22. This voltage will be imposed across resistors 62 and 78. Base 16 of output driver 18 will, therefore, be at the same potential as ground 22, and output driver 18 will not conduct. Capacitors 60 and 82 will then begin to charge. Because the time constant for charging capacitor 82 is smaller than for charging capacitor 60, the voltage across capacitor 82 will, within a time determined by the time constant of filter 14, reach and exceed values sufficient to forward bias base 16, causing output driver 18 to conduct. The conduction of output driver 18 permits current to flow from power source 94 to ground 22, thereby actuating the annunciator system 24.

After the voltage drop between wire or land 48 and ground 22 has been present for a time determined by the time constants of filters 12, capacitors 60 will reach a charge sufficient to lower the voltage across resistor 80 and capacitor 82 substantially equal to and below the conduction voltage of driver 18. This voltage reduction will cause the current through resistor 78 in the only direction permitted by diode 64 to drop substantially to zero.

Capacitor 82 will then quickly discharge to ground 22 through resistor 80, sharply cutting off the conduction of driver 18 and turning off annunciator system 24. Capacitor 60 will discharge through resistor 62 and lamp 44 at a rate set by the time constant of filter 12 after the voltage potential between conductor 48 and ground 22 has reached zero.

Driver 18 will also be inhibited from conducting by the discharge of capacitor 82 if the values of the voltage potentials between conductors 48 and ground 22 become equal to zero prior to the charging of the respective capacitors 60. This situation might occur after the presence of a sustained burst of noise. Normally, however, the time constant of actuation filter 14 is sufficiently long to prevent noise from causing capacitor 82 to charge sufficiently to forward bias base 16 and cause driver 18 to conduct.

Figure 2:
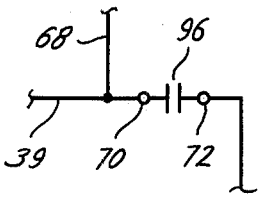
FIG. 2 is a partial schematic of the circuit of the preferred embodiment of the apparatus of the present invention showing the capacitor location for the filter that prevents circuit actuation within a given period of time of a previous actuation.

As shown in FIG. 1, when a capacitor 60 of a prior positive going transition has substantially reached its charged voltage, actuation filter 14 will respond to the positive going transition of any other input 10 if it occurs after a time greater than the time necessary for capacitor 82 to discharge below the necessary forward bias voltage of driver 18. To suppress this nuisance of quickly repeating annunciations by such closely time-spaced signals, a capacitor 96 (FIG. 2) may be inserted in place of jumper 74, thereby forming a third filter. The time constant of this third filter is determined by the value of capacitor 96. It should be in a range between the time constants of filter 12 and filter 14. The value of capacitor 96 is typically chosen to be one-tenth of the value of capacitor 62 and twice the value of capacitor 82. In the preferred embodiment, capacitor 96 is a one microfarad, 50 volt capacitor.

In operation, capacitor 96 will charge after capacitor 82 and prior to capacitor 60. Therefore, capacitor 96 will shield capacitor 82 from signals occurring as capacitor 60 charges. This shielding will last for a time period set by capacitor 96 and resistors 78 and 80.

Although the system described in detail supra is most satisfactory and preferred, many variations in structure and method are possible. For example, the annunciator system may include only a visual or audio mechanism, or it may include both connected in series with each other. Also, the output driver 18 may be any power transistor. Moreover, there may be any number of inhibiting filters 12, coupled with corresponding input circuits 10, connected to wire or land 68.

The above are examples of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A circuit for responding to bidirectional changes in state of an input signal at an input between a first state and a second state, the input being connected to a voltage potential through a switch, the first state of the input signal existing when the switch is open and the second state of the input signal existing when the switch is closed, the circuit comprising:

an output driver;

actuation means for actuating said output driver, said actuation means being responsive to a supply of current from such input; and inhibiting means for inhibiting the supply of current from said input to said actuation means, said inhibiting means being responsive only to the state of the input signal being time invariant for at least a first period of time and to changes in the state of the input signal from said second state to said first state.

2. The circuit of claim 1 wherein:

said actuating means having a first filter and said inhibiting means having a second filter; and said first filter having a first predominant time constant and said second filter having a second predominant time constant, said first predominant time constant being smaller than said second predominant time constant.

3. The circuit of claim 2 wherein said second predominant time constant is shorter than the period of time between successive changes of the state of the input in a single direction.

4. The circuit of claim 3 wherein said second predominant time constant is between 0.05 seconds and 1 second, and said first predominant time constant is in a range between five percent and thirty percent of said second predominant time constant.

5. The circuit of claim 2 wherein said second filter includes semiconductor means for lowering said first predominant time constant when said inhibiting means inhibits the supply of current to said actuation means.

6. The circuit of claim 1 wherein said actuation means includes a first filter means for delaying the actuation of said output driver in response to the supply of current to said actuation means from the input.

7. The circuit of claim 6 wherein said first filter means includes a first filter with a predominant time constant and said first filter inhibits the actuation of said output driver for successive changes in the state of the input from the first state to the second state, the changes being separated by a time less than said predominant time constant.

8. A circuit for responding to bidirectional changes in state of input signals at any of a plurality of inputs, each input being connected to a voltage potential through a switch, and each input signal varying between a first state when the switch is open and a second state when the switch is closed, the circuit comprising:

an output driver;

actuation means for actuating said output driver, said actuation means being responsive to a supply of current from any of said inputs; and inhibiting means for inhibiting the supply of current from said inputs to said actuation means only when none of the input signals are changing in state from the first state to the second state.

9. The circuit of claim 8 wherein:

said actuating means having a first filter with a first predominant time constant and said inhibiting means having a second filter with a second predominant time constant; and said first predominant time constant being smaller than any of said second predominant time constants.

10. The circuit of claim 9 wherein said second filter includes semi-conductor means for lowering said first predominant time constant when said inhibiting means inhibits the supply of current to said actuation means.

11. The circuit of claim 8 wherein said actuation means includes a first filter means for delaying the actuation of said output driver in response to the supply of current to said actuation means from any of the inputs.

12. The circuit of claim 11 wherein said first filter means includes a filter with a predominant time constant and said filter inhibits the flow of current to said actuating means for successive time variations of the states of the inputs from the first state to the second state, the changes being separated by a time less than said predominant time constant.

13. The circuit of claim 9 wherein there is further included third filter means, including a third filter with a third predominant time constant, for preventing the flow of current to said actuation means for changes in state of more than one of the inputs from the first state to the second state, the changes being separated in time less than said third predominant time constant.

14. The circuit of claim 13 wherein:

said actuation means includes a first filter with a first predominant time constant;

said inhibiting means includes second filters with second predominant time constants greater than said first predominant constant; and said third predominant time constant is greater than said first predominant time constant and less than said second predominant time constants.

15. The circuit of claim 14 wherein said third predominant time constant is in a range between forty percent and seventy percent of said second predominant time constants.

16. The circuit of claim 8 wherein there is further included annunciator means electrically connected to said output driver for signaling changes in state from the first state to the second state.

17. The circuit of claim 1 wherein there is further included annunciator means electrically connected to said output driver for signaling changes in state from the first state to the second state.

18. In an alarm system for alarm surveillance of the states of process variables, including several panels of electrically responsive alarm indicators with circuits for varying the voltage and current to the alarm indicators in response to alarm conditions of the states, the improvement comprising:

annunciator means for signaling the presence of variation in voltage and current to an alarm indicator;

first means responsive within a first period of time to the variations in the voltage and current to any of such alarm indicators for actuating said annunciator means; and second means responsive to the voltage and current to all of such alarm indicators becoming time invariant for a second period of time for inhibiting said first means, said second period of time being greater than said first period of time.

19. A circuit for responding to a change in voltage at an input from a quiescent first level to a second level, comprising:

an output driver;

actuation means responsive to the presence of the voltage at the second level for actuating said output driver;

inhibiting means responsive to the voltage remaining at the second level for inhibiting said actuation means from actuating said output driver; and discharge means responsive to the voltage remaining at the first level for deactivating said inhibiting means.

20. A system for the signaling of a unidirectional change in state of a multiplicity of input signals, comprising:

a plurality of first filters, each of said first filters having a first time constant and each of the input signals being connected to one of said first filters;

a plurality of diodes, the output of each of said first filters being connected to one of said diodes, said diodes being arranged to prevent activation of said corresponding first filter by a noncorresponding one of the input signals;

a bus electrically connecting the output of said diodes;

a second filter having a second time constant, said bus being electrically connected to said second filter and said second time constant being less than said first time constant;

output driver means electrically connected to the output of said second filter.

21. The system of claim 20 wherein there is further included third filter means having a third time constant, said third filter means being electrically connected between said bus and said second filter and said third time constant being greater than said second time constant and less than said first time constant.

* * * * *